US005628661A

United States Patent [19]

Kim et al.

[11] Patent Number: 5,628,661

[45] Date of Patent: May 13, 1997

[54] METHOD FOR FABRICATING A FIELD EMISSION DISPLAY

[75] Inventors: Jong-min Kim, Seoul; Nam-sin Park, Suwon, both of Rep. of Korea

[73] Assignee: Samsung Display Devices, Co., Ltd., Rep. of Korea

[21] Appl. No.: 473,206

[22] Filed: Jun. 7, 1995

[30] Foreign Application Priority Data

Jan. 27, 1995 [KR] Rep. of Korea ..... 95-1582

[51] Int. Cl.[6] ..... H01J 1/30; H01J 9/02

[52] U.S. Cl. ..... 445/24; 445/49; 445/50

[58] Field of Search ..... 445/24, 50, 49

[56] References Cited

U.S. PATENT DOCUMENTS

| | | | |
|---|---|---|---|
| 5,209,687 | 5/1993 | Konishi | 445/24 |
| 5,328,558 | 7/1994 | Kawamura | 437/228 |
| 5,330,606 | 7/1994 | Kubota et al. | 204/298.06 |
| 5,331,199 | 7/1994 | Chu et al. | 257/587 |
| 5,458,520 | 10/1995 | DeMercurio et al. | 445/24 |

FOREIGN PATENT DOCUMENTS

| | | | |
|---|---|---|---|
| 4-206124 | 7/1992 | Japan | 445/50 |

OTHER PUBLICATIONS

G.J. Campisi et al., *Mat. Res. Soc. Symp. Proc.*, vol. 76, 1987, pp. 67–72.

*Primary Examiner*—P. Austin Bradley
*Assistant Examiner*—Jeffrey T. Knapp
*Attorney, Agent, or Firm*—Cushman Darby & Cushman, IP Group of Pillsbury Madison & Sutro, L.L.P.

[57] ABSTRACT

A method is provided for fabricating a field emission device which can be adopted as the source for a flat panel display, an ultra-high frequency amplifier sensor, or an electron-beam-applied instrument. A polyimide layer is used as a release layer and a metal mask is formed thereon, thereby enabling the height of micro-tips to be easily controlled. Since the polyimide layer is soluble in an appropriate solvent, contamination does not occur during an etching process, thereby increasing the reliability of the device.

13 Claims, 4 Drawing Sheets

METHOD FOR FABRICATING A FIELD EMISSION DISPLAY

BACKGROUND OF THE INVENTION

The present invention relates to a method for fabricating a field emission device which can be used for a flat panel display, an ultra-high frequency amplifier sensor or an electron-beam-applied instrument.

In order to produce an image display device which can replace the cathode ray tube of existing television receivers, the flat panel display has been under vigorous development for use as an image display device for wall-mounted (tapestry) televisions or high definition televisions (HDTV). Such flat panel displays include liquid crystal devices, plasma display panels or field emission devices, among which the field emission device is widely used due to the quality of its screen brightness and low power consumption.

With a field emission device, since cathode tips (electron generating sources) can be highly integrated at about $10^4$–$10^5$ tips/mm$^2$ per unit pixel, very high brightness and high illuminating efficiency can be obtained with low electrical consumption. Field emission devices are expected to be adopted for wall-mounted televisions or HDTV.

The fabrication method of a conventional field emission device will now be described with reference to FIGS. 1A to 1D, in which FIG. 1A is a vertical cross-sectional view showing a hole formation, FIG. 1B is a vertical cross-sectional view showing a grazing angle deposition, FIG. 1C is a vertical cross-sectional view showing a micro-tip deposition, and FIG. 1D is a vertical cross-sectional view showing a completed conventional field emission device.

As shown in FIG. 1A, a cathode 2 is formed in a striped pattern on glass substrate 1 and an insulation layer 3 having a hole 8 with consistent dimensions is formed thereon. A gate electrode 4 having an aperture 6 is then formed on the insulation layer 3.

In FIG. 1B, a release layer 5 is deposited using a grazing angle deposition method.

In FIG. 1C, field emitting micro-tips 7 made of the same material as the cathode are deposited inside the holes in an array formation. The release layer 5 is etched to complete the field emission device, as shown in 1D.

In such a fabricating process, the step of forming the micro-tip array of tens of nanometers in size is the crucial part. At this time, a metal is used as the release layer 5. However, as shown in FIG. 1B, a grazing angle deposition method utilizes a specifically manufactured equipment. Since the thickness of the release layer 5 is fixed, a change in the geometrical structure such as the height of the tip cannot be tolerated, thereby lowering the uniformity of the emitted electrical field. Further, since an electrochemical etching or wet chemical etching process is adopted in removing the metal release layer 5, the residual metal material contaminates the device, causing current leakage in the device, and thereby lowering its reliability.

SUMMARY OF THE INVENTION

To solve the above-described problems, it is an object of the present invention to provide a method for fabricating a field emission device which can prevent current leakage due to contamination during the conventional fabrication process, without using a metal as a release layer and without adopting a separate deposition method.

To accomplish the above object, the method for fabricating a field emission device according to a present invention comprises the steps of: forming cathodes on a substrate in striped patterns; forming an insulation layer on the substrate having the striped cathodes formed thereon; forming gate electrodes by depositing a gate electrode layer on the insulation layer and etching the gate electrode layer in a predetermined striped pattern across the cathode; forming a polyimide layer on the insulation layer having the gate electrodes formed thereon; depositing a metal on the polyimide layer to form a metal layer; etching the metal layer to form openings having predetermined diameters; etching the polyimide layer to form holes aligned with the openings formed in the metal layer etching step; etching the gate electrodes to form apertures aligned with the holes formed in the polyimide layer etching step; etching the insulation layer to form holes aligned with the apertures formed in the gate electrode etching step; forming field emitting micro-tips on the cathodes of the bottom of the holes formed in the insulation layer etching step; and lifting off the polyimide layer.

According to a preferred embodiment of the present invention, the insulation layer is formed a of 1 μm thick layer of $SiO_2$ or $Al_2O_3$, and the gate electrode layer is formed of a 3,000–6,000 Å thick layer of molybdenum (Mo) or Niobium (Nb).

The polyimide layer forming step includes spin-coating a polyimide to a thickness of 2–3 μm and pre-baking the coated polyimide layer at a predetermined temperature for curing.

Aluminum is adopted as the metal layer and is deposited at a thickness of 2,000 Å.

The metal layer is etched by a reactive ion etching (RIE) process. The polyimide layer is etched using an oxygen plasma device. The gate electrode layer is etched using a $CF_4$-$O_2$, and the insulation layer is etched using a $CHF_3$-$O_2$ plasma device, respectively.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1A:
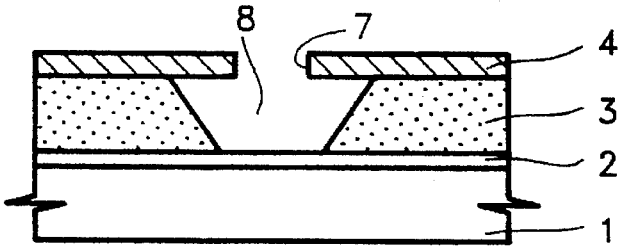
FIGS. 1A to 1D are vertical cross-sections showing the fabrication process of a conventional field emission device.
Figure 1B:
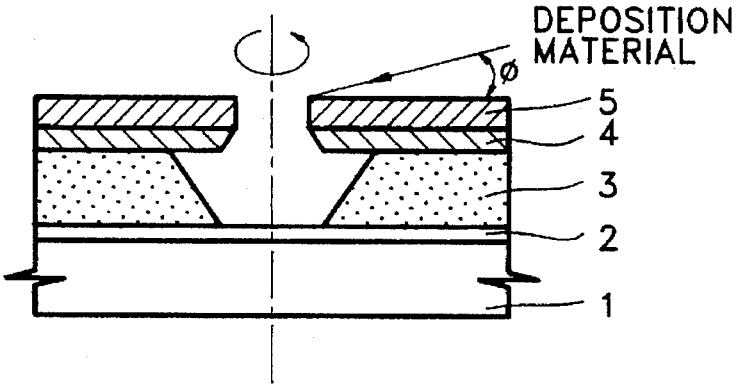
FIG. 1B (PRIOR ART)
Figure 1C:
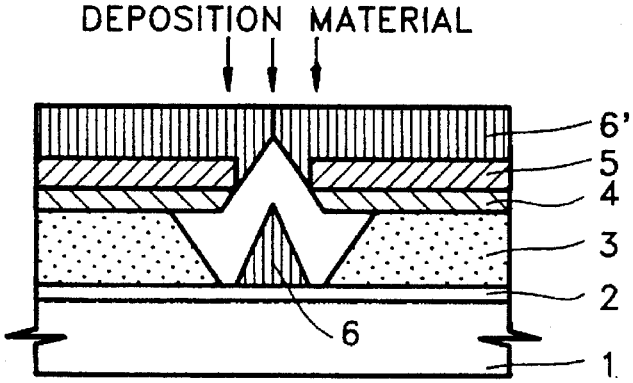
FIG. 1C (PRIOR ART)
Figure 1D:
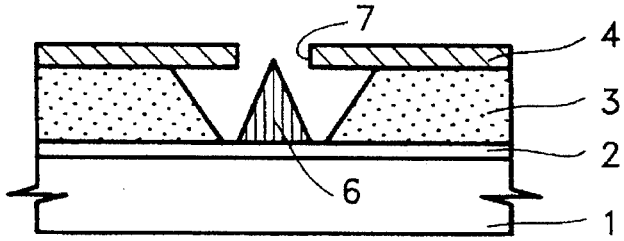
FIG. 1D (PRIOR ART)
Figure 2A:
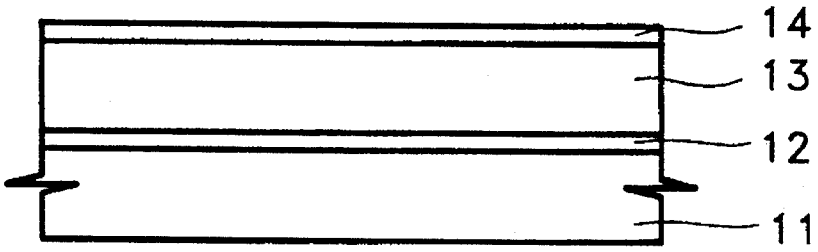
FIGS. 2A to 2I are vertical cross-sectional views showing the fabrication process of a field emission device according to the present invention.
Figure 2B:
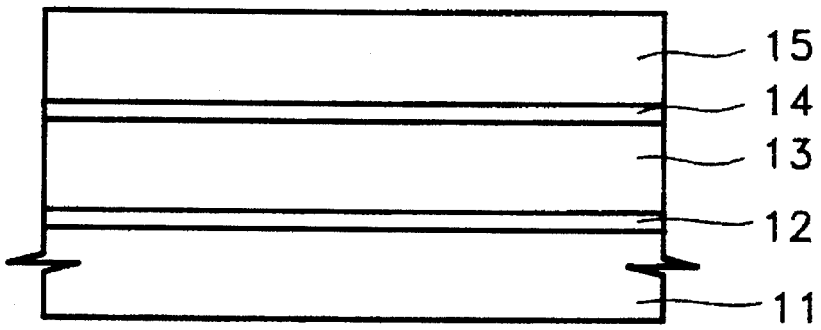
Figure 2C:
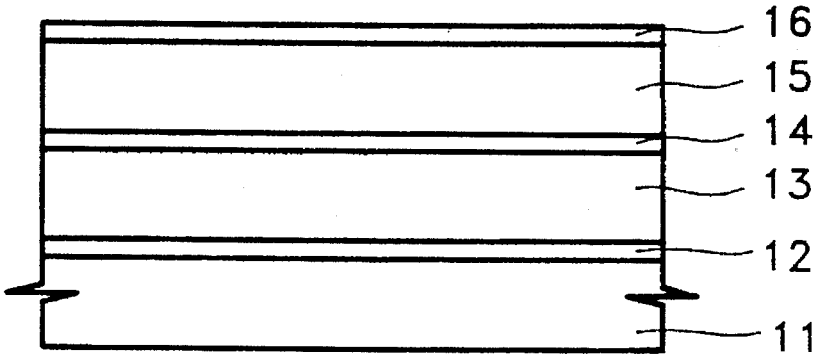
Figure 2D:
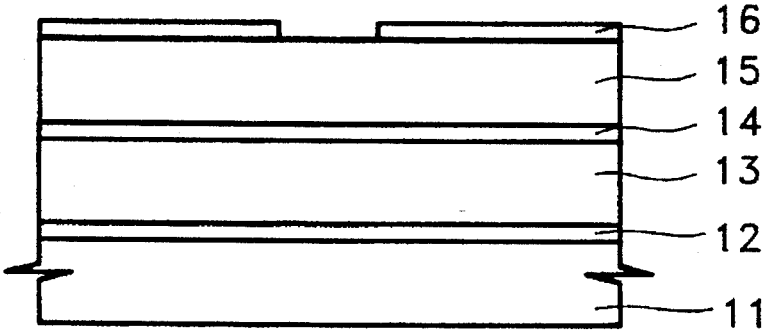
Figure 2E:
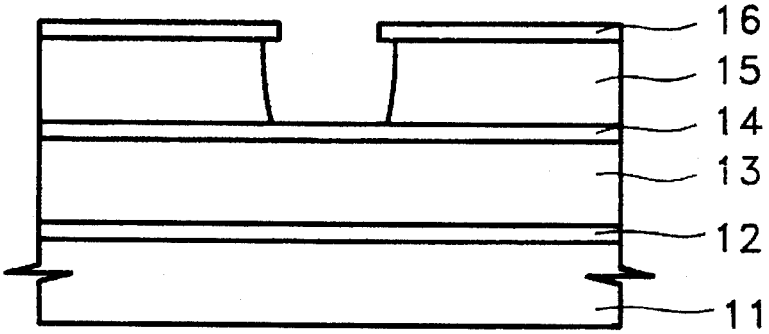
Figure 2F:
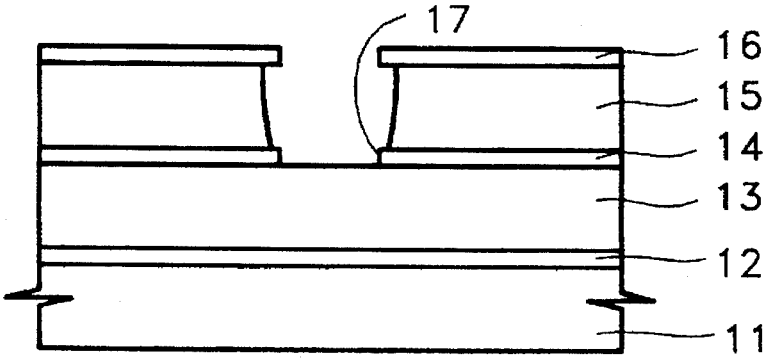
Figure 2G:
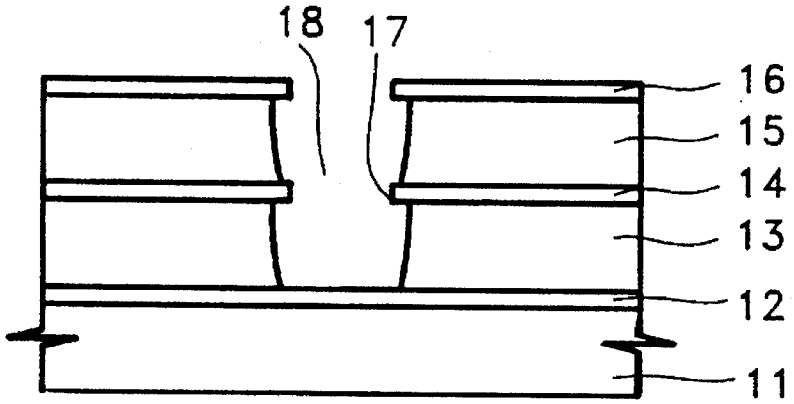
Figure 2H:
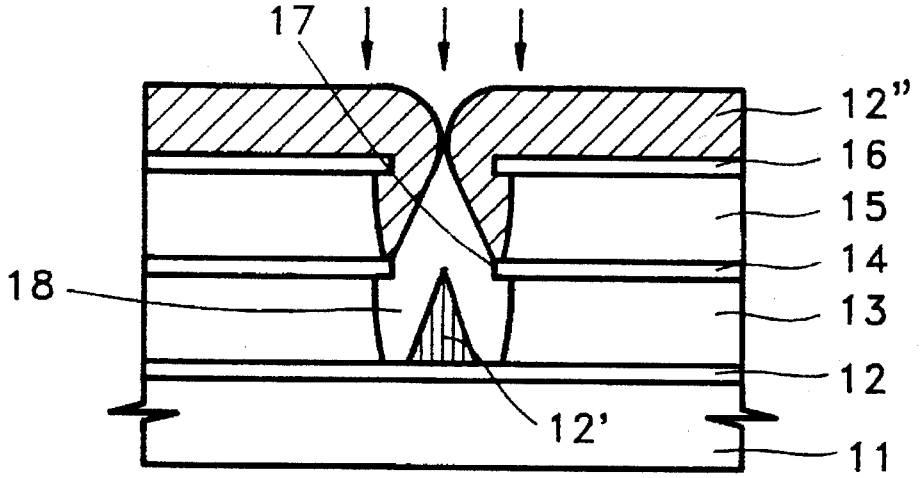
Figure 2I:
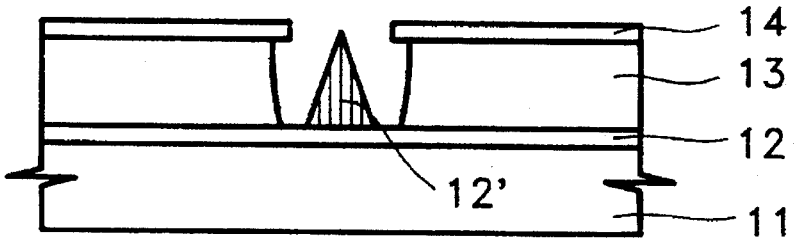

The field emission device according to the present invention (as shown in FIG. 2I) includes a glass substrate 11, cathodes formed on the glass substrate 11 in striped patterns, a plurality of field emitting micro-tips 12' formed on cathode 12 in an array formation, an insulation layer 13 surrounding the micro-tips 12' , and gate electrodes 14 formed on insulation layer 13 having an aperture 17 to allow field emission.

The fabrication method of the field emission device having the aforementioned configuration will now be described with reference to FIGS. 2A to 2I, in which FIG. 2A is a vertical cross-sectional view showing a gate electrode layer formation. FIG. 2B is a vertical cross-sectional view showing a polyimide layer formation. FIG. 2C is a vertical cross-sectional view showing an aluminum layer formation.

FIG. 2D is a vertical cross-sectional view showing an aluminum mask formation. FIG. 2E is a vertical cross-sectional view showing a polyimide layer etching by the aluminum mask. FIG. 2F is a vertical cross-sectional view showing a gate electrode layer etching, FIG. 2G is a vertical cross-sectional view showing an insulation layer etching. FIG. 2H is a vertical cross-sectional view showing a micro-tip formation, and FIG. 2I is a vertical cross-sectional view showing a completed field emission device according to the present invention.

First, as shown in FIG. 2A, indium tin oxide (ITO) which is a transparent material is deposited on glass substrate 11 and is etched in striped patterns to form cathodes 12. Thereafter, about 1 μm thick silicon dioxide ($SiO_2$) is deposited on the substrate having cathodes 12 to form an insulation layer 13. Then, 3,000–6,000 Å thick molybdenum (Mo) is deposited on insulation layer 13 in striped patterns across cathodes 12 to form gate electrodes 14.

Next, as shown in FIG. 2B, a polyimide 15 which is soluble in acetone or another solvent is spin-coated onto insulation layer 13 having gate electrodes 14 and is then pre-baked at a fixed temperature for curing, thereby forming a polyimide layer 15.

Then, as shown in FIG. 2C, Al metal 16 is deposited to a thickness of about 2,000 Å and, as shown in FIG. 2D, is etched in order to form the holes in the below layers and gate electrodes 14 wherein a field emitting micro-tip is to be formed, by a reactive ion etching (RIE) method. Thereafter, as shown in FIG. 2E, the polyimide layer 15 is etched by $O_2$ plasma. In FIG. 2F, the Mo gate electrodes 14 are etched by $CF_4$-$O_2$ plasma to form apertures 17, and FIG. 2G, the $SiO_2$ insulation layer 13 is etched by $CHF_3$-$O_2$ plasma to complete holes 18.

Next, as shown in FIG. 2H, Mo is deposited on cathodes 12 inside the holes to form micro-tips 12'.

Finally, as shown in FIG. 2I, Al layer 16 and residual Mo layer 12" deposited during micro-tip formation are lifted off, with a solvent such as acetone, along with the polyimide layer 15, to complete the device.

According to the field emission device fabricated by the above-described method, if the cathode 12 is grounded and about 20–100 volts are applied to gate electrode layer 14 having a positive potential, electrons due to the electric field effect are emitted from micro-tips 12'. The thus emitted electrons are accelerated via a vacuum ($10^{-6}$–$10^{-7}$ torr) to collide with a fluorescent material, thus emitting light to display the desired image.

If a radio frequency (rf) bias voltage is applied to the gate of the field emission device, the field emission device operates as a ultra-high frequency amplifier. If a control grid for controlling electron beams is adopted separately, the field emission device can be adopted for an electron beam applied system such as a sensor, a scanning electron microscope (SEM), or an electron-beam lithographical tool.

As described above, the method for fabricating a field emission device according to the present invention does not adopt a grazing angle deposition method by which a metal layer is utilized as a release layer. A polyimide layer is used as the release layer and a metal mask is formed thereon, thereby enabling the height of the micro-tip to be easily manipulated. Also, since polyimide is soluble in an appropriate solvent, contamination during an etching process does not occur, which increases the reliability of the device.

What is claimed is:

1. A method for fabricating a field emission device comprising the steps of:

forming cathodes on a substrate in striped patterns;

forming an insulation layer on said substrate having striped cathodes formed thereon;

forming gate electrodes by depositing a gate electrode layer on said insulation layer and etching said gate electrodes in a predetermined striped pattern across said cathodes;

forming a polyimide layer on said insulation layer having said gate electrodes formed thereon;

depositing a metal on said polyimide layer to form a metal layer;

etching said metal layer to form openings having predetermined diameters;

etching said polyimide layer to form holes aligned with said openings formed in said metal layer etching step;

etching said gate electrodes to form apertures aligned with said holes formed in said polyimide layer etching step;

etching said insulation layer to form holes aligned with said apertures formed in said gate electrodes etching step;

forming field emitting micro-tips on said cathodes on the bottom of said holes formed in said insulation layer etching step; and lifting off said polyimide layer;

wherein in said metal layer etching step, said metal layer is etched by a reactive ion etching (RIE) process.

2. A method for fabricating a field emission device comprising the steps of:

forming cathodes on a substrate in striped patterns;

forming an insulation layer on said substrate having striped cathodes formed thereon;

forming gate electrodes by depositing a gate electrode layer on said insulation layer and etching said gate electrodes in a predetermined striped pattern across said cathodes;

forming a polyimide layer on said insulation layer having said gate electrodes formed thereon;

depositing a metal on said polyimide layer to form a metal layer;

etching said metal layer to form openings having predetermined diameters;

etching said polyimide layer to form holes aligned with said openings formed in said metal laver etching step;

etching said gate electrodes to form apertures aligned with said holes formed in said polyimide laver etching step;

etching said insulation layer to form holes aligned with said apertures formed in said gate electrodes etching step;

forming field emitting micro-tips on said cathodes on the bottom of said holes formed in said insulation layer etching step; and lifting off said polyimide layer;

wherein in said insulation layer etching step, said insulation layer is etched by a $CHF_{3-O2}$ plasma.

3. A method for fabricating field emission device, said method comprising the steps of:

forming a cathode pattern comprising a layer of conductive material on an insulation substrate;

forming an insulation layer pattern comprising insulating material of a predetermined thickness over said cathode layer pattern;

forming a gate electrode layer pattern, comprising a layer of conductive material on said insulation layer;

forming a release layer pattern comprising a polymer with high temperature stability, over said gate electrode layer pattern; and forming micro-tips by depositing field emitting material over said release layer pattern; and etching said release layer pattern.

4. The method according to claim 3, wherein said release layer pattern comprises a polyimide layer.

5. A method for fabricating a field emission device comprising the steps of:

forming cathodes on a substrate in striped patterns;

forming an insulation layer on said substrate having striped cathodes formed thereon;

forming gate electrodes by depositing a gate electrode layer on said insulation layer and etching said gate electrodes in a predetermined striped pattern across said cathodes;

forming a polyimide layer on said insulation layer having said gate electrodes formed thereon;

depositing a metal on said polyimide layer to form a metal layer;

etching said metal layer to form openings having predetermined diameters;

etching said polyimide layer to form holes aligned with said openings formed in said metal layer etching step;

etching said gate electrodes to form apertures aligned with said holes formed in said polyimide layer etching step;

etching said insulation layer to form holes aligned with said apertures formed in said gate electrodes etching step;

forming field emitting micro-tips on said cathodes on the bottom of said holes formed in said insulation layer etching step; and lifting off said polyimide layer.

6. A method for fabricating a field emission device as claimed in claim 5, wherein said insulation layer is formed of a 1 μm thick layer of $SiO_2$.

7. A method for fabricating a field emission device as claimed in claim 5, wherein said insulation layer is formed of a 1 μm thick layer of $Al_2O_3$.

8. A method for fabricating a field emission device as claimed in claim 5, wherein said gate electrode layer is formed of a layer of molybdenum (Mo) having a predetermined thickness.

9. A method for fabricating a field emission device as claimed in claim 5, wherein said polyimide layer forming step includes the steps of spin-coating a polyimide to a thickness of 2–3 μm, and pre-baking the coated polyimide layer at a predetermined temperature to cure the same.

10. A method for fabricating afield emission devices as claimed in claim 5, wherein in said metal depositing step, said metal is aluminum and is deposited to form a predetermined thickness of aluminum.

11. A method for fabricating a field emission device as claimed in claim 5, wherein in said polyimide layer etching step, said polyimide layer is etched by an $O_2$ plasma.

12. A method for fabricating a field emission device as claimed in claim 5, wherein in said gate electrode etching step, said gate electrodes are etched by a $CF_4$-$O_2$ plasma.

13. A method for fabricating a field emission device as claimed in claim 5, comprising using said polyimide layer as a release layer.

* * * * *